US009901932B2

(12) United States Patent
Eves

(10) Patent No.: US 9,901,932 B2
(45) Date of Patent: Feb. 27, 2018

(54) DENSE MEDIA SEPARATION METHOD

(71) Applicant: Eco-nomic Innovations Limited, Aughnacloy, County Tyrone (GB)

(72) Inventor: Jonathan Eves, Aughnacloy (GB)

(73) Assignee: Eco-Nomic Innovations Limited (GB)

( * ) Notice: Subject to any disclaimer, the term of this patent is extended or adjusted under 35 U.S.C. 154(b) by 0 days.

(21) Appl. No.: 15/121,077

(22) PCT Filed: Feb. 27, 2015

(86) PCT No.: PCT/EP2015/054186

§ 371 (c)(1),
(2) Date: Aug. 24, 2016

(87) PCT Pub. No.: WO2015/128486

PCT Pub. Date: Sep. 3, 2015

(65) Prior Publication Data

US 2016/0361725 A1 Dec. 15, 2016

(30) Foreign Application Priority Data

Feb. 28, 2014 (GB) ..... 1403568.7
Dec. 2, 2014 (GB) ..... 1421395.3

(51) Int. Cl.
*B03C 1/00* (2006.01)
*B03C 1/30* (2006.01)
(Continued)

(52) U.S. Cl.
CPC ..... *B03C 1/30* (2013.01); *B03C 1/01* (2013.01); *B03C 1/288* (2013.01); *B03C 1/32* (2013.01);
(Continued)

(58) Field of Classification Search
CPC .... B03C 1/01; B03C 1/30; B03C 1/32; B03C 1/288
(Continued)

(56) References Cited

U.S. PATENT DOCUMENTS 2,988,212 A * 6/1961 Walker ..... B03B 5/34 209/17
4,169,786 A * 10/1979 Horsfall ..... B03B 5/447 209/17
(Continued)

FOREIGN PATENT DOCUMENTS

DE 102008050953 A1 4/2010
FR 2725762 A1 4/1996
(Continued)

OTHER PUBLICATIONS

Search Report under Section 17 for Application No. GB1504364.9 dated Sep. 15, 2015.

*Primary Examiner* — Terrell H Matthews
(74) *Attorney, Agent, or Firm* — Burns & Levinson LLP; John C. Serio; Marlo Schepper Grolnic

(57) ABSTRACT

A method of separating solids, the method comprising: •adding said solids to a suspension of particulate material comprising magnetic, or magnetized, particles in a liquid, •locating the combined solids and suspension in a separation vessel such that rotation is imparted to the combined solids and suspension around a space bounded by an outer wall of the vessel to impart a centrifugal force on the solids; and •applying, during operation of said separation vessel, a magnetic field to said combined solids and suspension in said separation vessel to impart a magnetic biasing force on the particles of said particulate material in an inwards direction away from the outer wall of the vessel at least in a lower region of the vessel, •wherein said particulate material has a coarseness (particle size) that is determined by at least one of the size of said separation vessel, the particulate material shape and type, the solids particle size and type, the feed pressure of the combined solids and suspension, and a desired specific gravity of said suspension, and wherein said method further comprises: •causing said
(Continued)

particulate material to be relatively coarser (larger) than a nominal coarseness that is determined by at least one of the size of said separation vessel, the particulate material shape and type, the solids particle size and type, the feed pressure of the combined solids and suspension, and a desired specific gravity of said suspension in the absence of said magnetic field.

11 Claims, 3 Drawing Sheets

(51) Int. Cl.
*B03C 1/01* (2006.01)
*B03C 1/28* (2006.01)
*B03C 1/32* (2006.01)

(52) U.S. Cl.
CPC ..... *B03C 2201/18* (2013.01); *B03C 2201/20* (2013.01); *B03C 2201/24* (2013.01)

(58) Field of Classification Search
USPC ..... 209/214
See application file for complete search history.

(56) References Cited

U.S. PATENT DOCUMENTS

| | | | | |
|---|---|---|---|---|
| 4,594,149 | A * | 6/1986 | Andres | B03B 7/00 209/1 |
| 5,794,791 | A * | 8/1998 | Kindig | B03B 5/34 209/12.1 |
| 5,795,025 | A | 8/1998 | Murphy | |
| 6,024,226 | A * | 2/2000 | Olivier | B03B 5/30 209/172.5 |
| 6,045,070 | A * | 4/2000 | Davenport | B02C 7/04 175/206 |
| 2006/0016728 | A1* | 1/2006 | Shorts | B01D 45/12 209/1 |
| 2011/0017675 | A1* | 1/2011 | Larson | E21B 21/065 210/695 |
| 2014/0300147 | A1 | 10/2014 | Suhre et al. | |
| 2016/0045841 | A1* | 2/2016 | Kaplan | B01J 19/0093 429/49 |

FOREIGN PATENT DOCUMENTS

| | | |
|---|---|---|
| FR | 2882306 A1 | 8/2006 |
| FR | 2963587 A1 | 2/2012 |

* cited by examiner

Fig 5

Table 1: Non- Magnetic Cyclone

| Cyclone Diameter | Media Size | Error of Separation (Ep) | Cut Point | Medium Flowrate |
|---|---|---|---|---|
| 100 mm | 79% -45 microns | 0.03 | 2.29 SG | 45 l/min |

Fig 6

Table 2: Magnetic Cyclone

| Cyclone Diameter | Media Size | Error of Separation (Ep) | Cut Point | Medium Flowrate |
|---|---|---|---|---|
| 100 mm | 40% -45 microns | 0.02 | 2.74 SG | 72 l/min |

DENSE MEDIA SEPARATION METHOD

CROSS-REFERENCE TO RELATED APPLICATIONS

This application is a U.S. national stage application under 35 U.S.C. 371 of co-pending International Application No. PCT/EP2015/054186 filed on Feb. 27, 2015 and entitled DENSE MEDIA SEPARATION METHOD, which in turn claims priority to Great Britain Patent Application Nos. 1403568.7, filed on Feb. 28, 2014, and 1421395.3, filed on Dec. 2, 2014, the contents of which are incorporated by reference herein in their entirety for all purposes.

FIELD OF THE INVENTION

The present invention relates to the separation of solids. The invention relates particularly to Dense Media Separation (DMS).

BACKGROUND TO THE INVENTION

Dense Media Separation (DMS)—also known as Heavy Media Separation—is a process widely used in the mining industry to separate the valuable minerals from the non-valuable rock by differences in density. For example, DMS can be used in the diamond industry because diamond is denser than the host rock, and also in the iron ore industry because haematite is denser than silica. In the coal industry where coal is less dense than silica, DMS may also be used.

The DMS process involves the use of a suspension of particulate material in a liquid, typically water. The particulate material, or media, preferably comprises magnetic particles, for example magnetite or ferrosilicon (FeSi) particles because this facilitates the recovery of the particulate material for reuse after the separation process. The particles of the particulate material are sufficiently fine to allow their stable suspension in the relevant liquid, and typically take the form of powder, while being sufficiently dense/heavy to provide the required media density. For example, a 350 mm cyclone operating in the diamond industry on +1 mm to 4 mm kimberlite using ferrosilicon as the suspension media uses medium with approximately 90% of the media particles finer than 44 micrometers. The media particles are typically formed by milling or atomisation. The resulting media suspension is commonly referred to as a dense medium. Where the particulate material comprises magnetic or magnetised particles, the media suspension may be referred to as a magnetic dense medium. The media suspension has a density greater than that of the liquid alone. For example a typical dense medium may have an apparent density of, say, 2.65 specific gravity while the specific gravity of water is 1. The advantage of using a magnetic particulate material is to facilitate subsequent retrieval of the particulate material for reuse.

During use, the media suspension is contained in a separation vessel, for example a cyclone vessel (sometimes referred to as a dense medium cyclone). The media suspension is usually mixed with the solids to be separated (typically comprising ore but is also used in the recycling industry for metal and plastic recycling) before being transferred to the separation vessel. Where the separation vessel comprises a cyclone, separation is effected by differences in centrifugal force experienced by particles of the solids to be separated of differing density, the less dense material tending to float in the liquid suspension and so exiting the cyclone at the top, while the denser material sinks and exits through the bottom.

A problem with DMS is that the suspended media tends to separate from the media suspension along with the solids to be separated as a result of its relatively high density (typically between 6.7 and 7.1 specific gravity for ferrosilicon). Therefore a stable media is required for optimum DMS efficiencies, and optimum efficiencies are a priority more than ever with high commodity prices. Stability is achieved using powdered media that is fine enough to prevent rapid settling of the media under the centrifugal forces in the cyclone or gravity in the case of a Dense Media Drum. It is this fineness that gives rise to most media losses for reasons including the following:

1. Fine suspension media adheres to the ore/solids surface and is difficult to wash off from the recovered product at the end of the process. This is a particular problem for porous materials, such as coal.
2. Fine suspension media is more susceptible to corrosion (e.g. oxidation) due to the high surface area to volume.
3. Fine suspension media is more difficult to recover in magnetic separators. The higher hydrodynamic drag forces that fine particles experience, results in poor recovery of finer media in the magnetic separators.

Commercially available Ferrosilicon is manufactured as either milled or atomised. The atomised version is commonly manufactured in five size fractions: Special Coarse, Coarse, Fine, Cyclone 60 and Cyclone 40 and, because it is spherical, it is more easily washed, more resistant to corrosion but is more expensive. Milled ferrosilicon is cheaper and is commercially available in six different sizes: 100#, 65D, 100D, 150D, 270D, 270F (from for example DMS Powders (www.dmspowders.com) or M & M Alloys Limited (www.mandmalloys.com). In conventional DMS plants where the required media SPECIFIC GRAVITY is greater than 3.2, as in iron ores, the viscosity of the milled media is too great for efficient separation and atomised ferrosilicon is used.

Generally, the smaller the cyclone diameter, the larger the centrifugal forces experienced by the media particles in the cyclone and finer media is required for good stability. Larger cyclones have lower centrifugal forces and the media particles do not need to be so fine for stability. However, feed pressure of the combined solids and media suspension is usually increased with increasing cyclone diameter and coal DMS plants operating with magnetite as the media tend to use one particle size for all cyclone diameters.

Typically, ferrosilicon losses in cyclone DMS circuits range from 120 g ferrosilicon per tonne (g/t) up to 500 g/t. Magnetite is a cheaper alternative to ferrosilicon. However, magnetite is less dense than ferrosilicon and therefore losses tend to be higher. Media losses are known to represent from 20% to 40% of the total operating costs of a DMS plant.

It would be desirable to reduce media losses in DMS systems.

SUMMARY OF THE INVENTION

In arriving at the present invention it is recognised that the mechanisms for media recovery in a DMS system tend to lose the relatively fine media. Therefore by eliminating or reducing the need for such fine media, media losses are reduced significantly. The elimination or reduction of fine media also reduces the viscosity of the media suspension and therefore increases the efficiency of separation.

Accordingly, a first aspect of the invention provides a method of separating solids, the method comprising:

adding said solids to a suspension of particulate material comprising magnetic, or magnetised, particles in a liquid, locating the combined solids and suspension in a separation vessel such that rotation is imparted to the combined solids and suspension around a space bounded by an outer wall of the vessel to impart a centrifugal force on the solids; and applying, during operation of said separation vessel, a magnetic field to said combined solids and suspension in said separation vessel to impart a magnetic biasing force on said particles in an inwards direction away from the outer wall of the vessel at least in a lower region of the vessel, wherein said particulate material has a coarseness (particle size) that is determined by at least one of the size of said separation vessel, the particulate material shape and type, the solids particle size and type, the feed pressure of the combined solids and suspension, and a desired specific gravity of said suspension, and wherein said method further comprising:

causing said particulate material to be relatively coarser (larger) than a nominal coarseness that is determined by at least one of the size of said separation vessel, the particulate material shape and type, the solids particle size and type, the feed pressure of the combined solids and suspension, and a desired specific gravity of said suspension in the absence of said magnetic field.

Typically, said particulate material comprises particles having a size (typically width) that is larger than a nominal particle size (typically width) that is determined by at least one of the size of said separation vessel, the particulate material shape and type, the solids particle size and type, the feed pressure of the combined solids and suspension, and a desired specific gravity of said suspension in the absence of said magnetic field. All of the particles in a quantity of said particulate material may not be of identical size or coarseness, in which case the coarseness or particle size of said particulate material may be an average or typical coarseness or particle size.

In preferred embodiments, said separation method comprises a Dense Media Separation (DMS) method. Said suspension of particulate material preferably comprises a magnetic dense medium.

Preferably, said separation vessel comprises a cyclone vessel, more preferably a dense medium cyclone.

Preferably, said particulate material comprises magnetic, or magnetised, particulate material, for example ferrosilicon or magnetite.

In one embodiment the method may comprise the steps of:

a. increasing the coarseness of the particles of said particulate material from said nominal particle size by a predetermined amount;

b. determining the density differential (difference in density between the underflow and overflow from the separation vessel) as a function of the magnetic field and identifying the magnetic field strength required to reduce the density differential to a predetermined optimum value;

c. determining the density cut point and error of separation at said magnetic field strength determined by step (b);

d. further increasing the particle coarseness (size) in predetermined steps and repeating steps (b) and (c) until the error of separation increases; and e. determining the maximum particle coarseness used before the error of separation increased and using said maximum particle coarseness for subsequently separating solids while applying a magnetic field to the combined solids and suspension in the separation vessel.

The coarseness of the particles may be increased by 30% between said predetermined steps.

The method may further comprise the initial step of determining the density cut point and error of separation of the separation method when using particulate material having said nominal coarseness.

Over time, an optimum particle coarseness will be established by industry for each specific application of this invention and later adopters of the invention may use the particle coarseness determined by the early adopters using the said method without having to repeat the said method for themselves.

Preferred embodiments of the invention can reduce the cost of media losses by up to 90% while increasing separation efficiency.

In preferred embodiments, said magnetic flux density applied to the combined solids and suspension is between 1 and 300 gauss (between 0.1 and 30 mT) for a separating vessel of 100 mm diameter. This increases the stability of the media suspension in the separation vessel so that relatively coarse media may be used without losing media stability and separation efficiency. The use of coarser media reduces media losses and media viscosity. Lower media viscosity improves the quality of separation in DMS systems of all sizes. Large separating vessels will require an exponentially larger magnetic field flux density.

The preferred method allows relatively large media particle sizes to be used while maintaining optimum separation efficiency in dense medium cyclones.

In a further aspect, the present invention provides a method of separating solids, the method comprising the steps of:

adding said solids to a suspension of particulate material comprising magnetic, or magnetised, particles in a liquid, locating the combined solids and suspension in a separation vessel such that rotation is imparted to the outer wall of the vessel to; and applying, during operation of said separation vessel, a magnetic field to said combined solids and suspension in said separation vessel to impart a magnetic biasing force on the particles of said particulate material in an upwards direction, opposite to the gravitational force effecting the separation;

wherein said particulate material has a coarseness (particle size) that is determined by at least one of the particulate material shape and type, the solids particle size and type, and a desired specific gravity of said suspension, and wherein said method further comprises:

causing said particulate material to be relatively coarser (larger) than a nominal coarseness that is determined by at least one of the particulate material shape and type, the solids particle size and type, and a desired specific gravity of said suspension in the absence of said magnetic field.

Preferably said separation vessel comprises a dense medium drum.

In a further aspect, the present invention provides a method of separating solids, the method comprising:

adding said solids to a suspension of particulate material in a liquid, typically water;

locating the combined solids and suspension in a separation vessel; and applying, during operation of said separation vessel, a substantially vertical and upwardly directed magnetic field to said combined solids and suspension in said separation vessel, wherein said particulate material comprises magnetic, or magnetised, particles having a coarseness (size) that is determined by at least one of the size of said separation vessel and a desired specific gravity of said suspension, and wherein said method further comprises:

causing said particulate material to be relatively coarser (larger) than a nominal coarseness that is determined by at least one of the size of said separation vessel, a desired specific gravity of said suspension in the absence of said magnetic field.

Further advantageous aspects of the invention will become apparent to those skilled in the art upon review of the following description of preferred embodiments and with reference to the accompanying figures.

BRIEF DESCRIPTION OF THE DRAWINGS

Embodiments of the invention are now described by way of example and with reference to the accompanying figures in which:

FIG. 5 shows a table tabulating typical media particle size against separation efficiency, density cut point and cyclone capacity;

FIG. 6 shows a table tabulating preferred media particle size against separation efficiency, density cut point and cyclone capacity in the presence of a magnetic field;

DETAILED DESCRIPTION OF THE DRAWINGS

Figure 1:
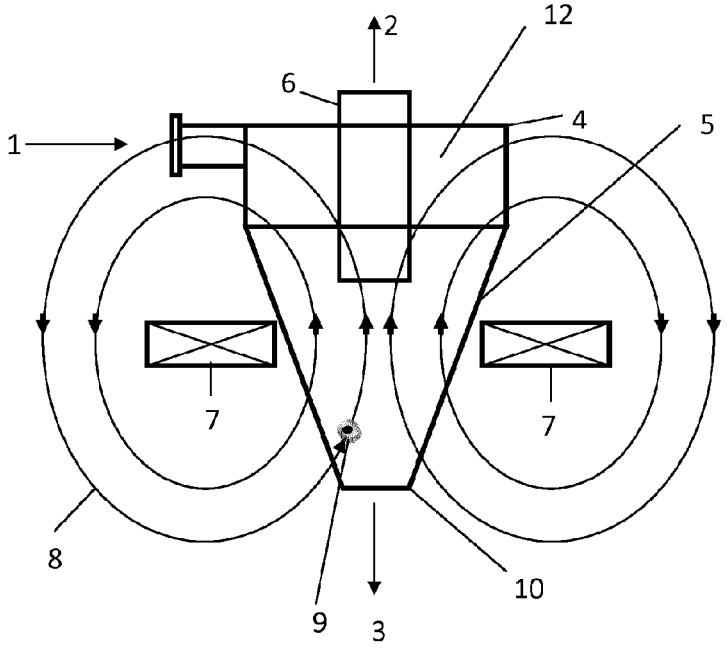
FIG. 1 is a schematic representation of a dense medium cyclone being part of a DMS system.

Referring now to FIG. 1 of the drawings, there is shown a cyclone vessel 12 being part of a DMS system. The cyclone has an inlet 1 through which, in use, a mix of media suspension (preferably magnetic dense medium) with solids for separation (typically comprising ore) is fed. The mixture is spun around in the cylindrical section 4 of the cyclone 12 where separation begins to take place with relatively dense particles moving outwards towards the side walls of the cyclone 12 and the less dense particles moving towards the centre of the cyclone 12.

The mixture passes into the cone section, or frustum 5, where separation continues to take place. The less dense particles of the separated solids tend to float and move towards the centre of the cyclone 12 where they exit the cyclone 12 via an outlet 6, commonly known as a vortex finder, as indicated by arrow 2. The particles exiting via the outlet 6 are carried by the media suspension. The heavier, or relatively dense, particles of the separated solids sink, tending to move to the sides of the cyclone 12, and exit the cyclone via an outlet 10, for example comprising a spigot 10, as indicated by arrow 3. The particles exiting via the outlet 10 are carried by the media suspension.

It is envisaged that cyclone separation devices having numerous different geometries may be used, having cylindrical or conical sections or a combination of both, having a vertical or inclined axis. A common feature of such cyclone separation devices is that the feed material is fed into the chamber in a direction substantially tangential to a curved side wall of the chamber such that the feed material is constrained to flow around the curved wall, inducing a swirling flow pattern in the feed material such that the particles entrained in the feed material are subject to a centrifugal force towards the outer wall of the vessel.

A magnetic field generator 7, for example comprising a suitably energised solenoid or permanent magnet, generates a magnetic field 8 during the separation process which extends into the separation chamber defined by the cyclone 12. The magnetic field generator 7 is configured and positioned with respect to the cyclone 12 such that it generates a magnetic biasing force on the magnetic or magnetised particles in the suspension, at least in a lower region of the cyclone 12, in a direction inwardly towards a central region of the separation chamber, away from the outer wall of the separation chamber, in the separation chamber defined by the cyclone 12, especially in the cone section 5. Conveniently, the magnetic field generator 7 comprises a ring structure that surrounds the cyclone 12. In preferred embodiments, the magnetic field generator 7 is configured to apply a magnetic flux density of between 1 and 300 gauss to the media suspension, suitable for a cyclone separating vessel having a diameter of 100 mm. Larger vessels will require exponentially larger magnetic flux densities.

The position of the magnetic field generator may be moved up or down the cyclone to optimise its performance. Should the magnetic field generator be a solenoid, its current may be varied to optimise the magnetic flux density. The solenoid may be an iron yoke type or multi-pole type and its windings may be varied to optimise the required magnetic field shape. The magnetic force generated is directed away from the side walls of the separating chamber. The magnetic field thus may be horizontal, but a solenoid generating a vertical magnetic field is considered the most practical.

Figure 2:
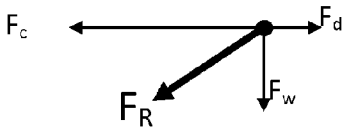
FIGS. 2 and 3 are vector diagrams illustrating the key forces acting on differently sized particles in a cyclone vessel.

With the solenoid 7 switched off (or the magnetic field otherwise removed), FIG. 2 diagrammatically illustrates the forces acting on a fine particle of media 9 in the lower left hand corner of the cyclone in FIG. 1. $F_c$ denotes the centrifugal force on the particle due to the spinning of the suspension in the cyclone. This centrifugal force $F_c$, causes the media particle to move towards the wall of the cyclone where the heavier ore particles have now concentrated. $F_d$ denotes the hydrodynamic drag force experienced by the particle as it moves through the water towards the frustum wall 5. $F_w$ denotes the force exerted by the particle's own weight under gravity. $F_R$ denotes the sum of the forces i.e. the resultant force.

The direction of the resultant force in FIG. 2 illustrates the tendency of the media particles to exit the cyclone through the spigot 10 rather that travel to the centre of the cyclone and exit the vortex finder 6. This tendency is observed in the operation of the DMS cyclone 12 where the spigot media density is always greater than the media density at the vortex finder exit under normal operating conditions. The difference in density between the underflow 3 and overflow 2 of the cyclone 12 is known as the differential. High differentials are known have a negative effect on the quality of separation. The cyclone differential is primarily controlled by the fineness of the media particles used in the DMS system and hence when designing a DMS system the type of media and its shape and size distribution are of primary consideration.

Figure 3:
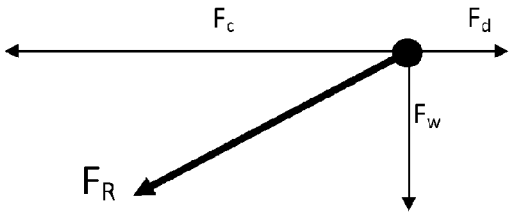

Still with the solenoid 7 switched off (or the magnetic field otherwise removed), FIG. 3 diagrammatically illustrates the forces acting on a coarser (larger) particle of media with increased mass in the same position as that of the finer particle in FIG. 2. The increase in size has lead to a large increase in $F_c$ and $F_w$ due to an increase in mass but only a small increase in $F_d$ as the change in the drag force is a function of the diameter of the particle which is approximately ¼ the increase in mass. The large increase in the resultant force $F_R$ demonstrates that the large media particle moves quickly towards the walls of the cyclone and exits via the spigot 10 together with the denser ore particles and the media density differential will be excessive.

Figure 4:
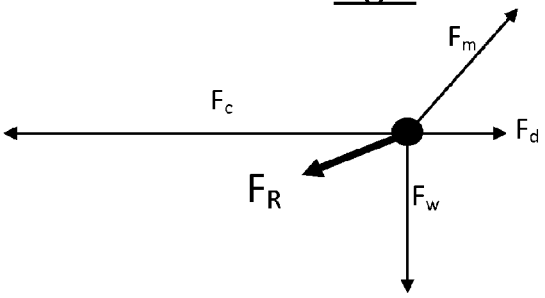
FIG. 4 is a vector diagram illustrating the key forces acting on a particle in a cyclone vessel in the presence of a magnetic field.

When the magnetic field 8 is present, FIG. 4 diagrammatically illustrates the forces acting on the coarser particles of media (with increased mass in the same position as that of the fine particle in FIG. 2) in the magnetic field. The magnetic force on the media particle, denoted $F_m$, acts in approximately the opposite direction to the resultant force $F_R$ inwardly away from the wall of the cyclone, thus reducing the $F_R$ experienced by the larger media particle so that is similar that of the fine media particle in FIG. 2. Hence, when exposed to the magnetic field, coarser media experiences similar resultant forces to that of finer media particles when there is no magnetic field.

As a result, the exposure of the media to the magnetic field allows larger media particles to be used in the DMS cyclone 12 without the differential rising excessively. The larger (courser) media particles have the advantages of:

1. Coarse media has a lower surface area and is therefore less susceptible to corrosion e.g. oxidation.
2. Coarser media particles are more easily washed from DMS products.
3. Coarser media is more easily captured in magnetic separators used to recover the magnetic media.
4. The coarser media particles provide a lower viscosity media with improved separation.
5. The lower viscosity allows for increased medium throughput through the separator for the same feed pressure and hence increased centrifugal forces in the separator which improves both the separation and capacity of the system.
6. The coarser media allows high medium densities to be achieved.
7. Less dense and less expensive suspension media can be used, for example magnetite as an alternative to ferrosilicon, as the course particles allow for a higher percentage solids content to be used in the medium to compensate for the lower density of the material.

Currently, magnetite alone is used when a density cut point is required in the range 1.25 to 2.2 g/cm$^3$ and a mixture of magnetite and the more expensive ferrosilicon, or 100% ferrosilicon, is used above that. The use of coarser media together with the magnetic fields allows magnetite media to be used above 2.7 g/cm$^3$. Therefore magnetite alone may be used to separate quartzite and other silica based rock from denser valuable minerals such as diamond for the first time. The bimodal distributions that can be achieved using the coarser media may play an important role in achieving these higher densities. The density limit of 3.7 specific gravity for DMS using 100% ferrosilicon can now be increased.

Figure 7:
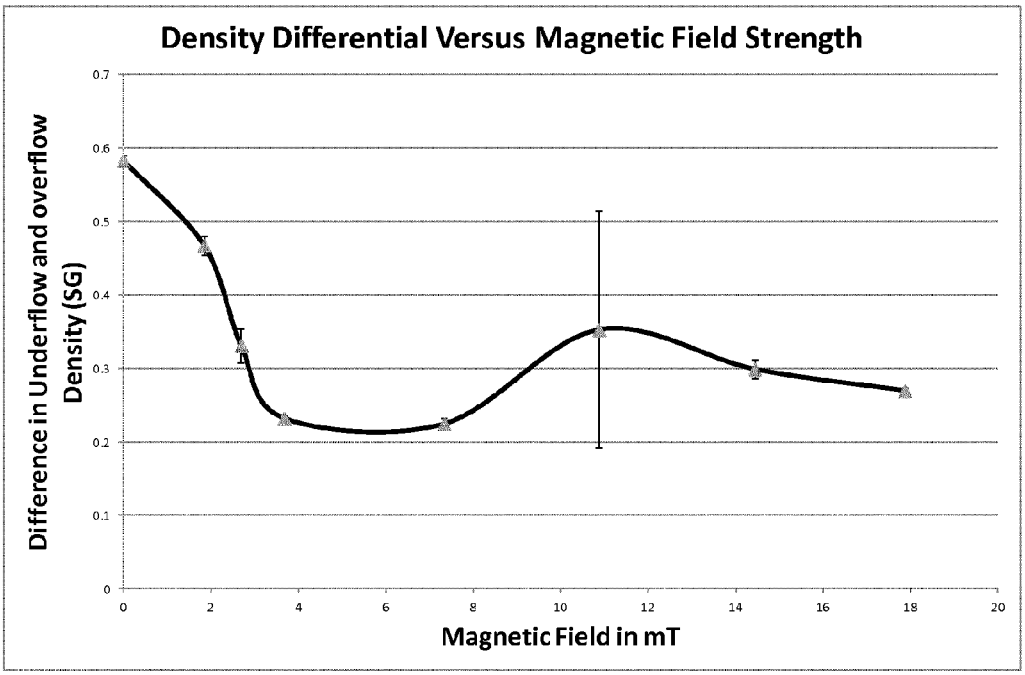
FIG. 7 is a graph of density differential against magnetic field strength.
Figure 8:
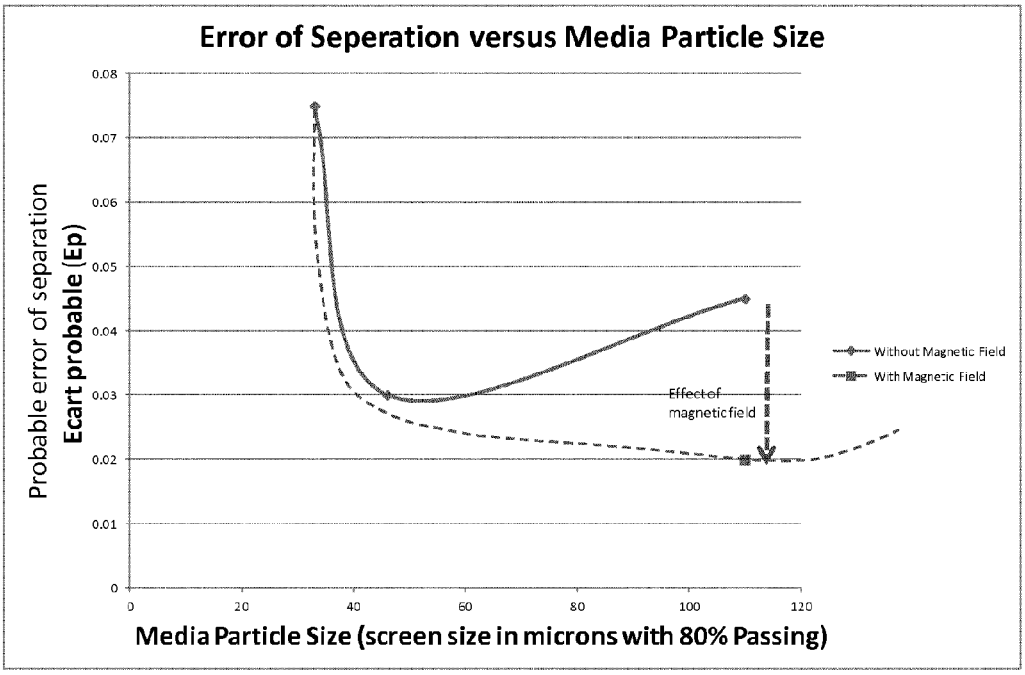
FIG. 8 is a graph of error of separation against media particle size.

In a process in accordance with a preferred embodiment of the present invention, the particle size (coarseness) for a given separation process and the required magnetic field strength may be determined as follows:

1. Determine or establish the density differential (difference in density between the underflow and overflow medium density), density cut point and Ep (error of separation) by using an existing DMS plant for the given separation, or suitable DMS pilot plant, for particulate material having a nominal particle as used in the industry for the given separation (without a magnetic field). Over the decades that DMS plants have been operated, the correct medium particle size distribution for each application is well known and documented. For instance, in the diamond industry, the use of 270D ferrosilicon is widely accepted as the correct particle size for the recovery of 1 mm to 4 mm diamonds from kimberlite in a 350 mm cyclone operating at a head of 12 times the cyclone diameter.
2. Replace the nominally sized particulate material with material that is 30% coarser.
3. Identify the minimum magnetic flux density strength required to reduce the density differential to below 0.4 g/cm3 (a differential of just 0.4 g/cm3 is considered the optimum operating point for cyclone DMS) by drawing a graph of density differential versus magnetic flux density strength, as shown in FIG. 7.
4. Determine the density cut point and Ep (error of separation), possibly using tracer tests or densiometric analysis at the magnetic flux density determined in step 3.
5. Replace the particle material with media 30% coarser and repeat steps 3 and 4 for the coarser material.
6. Repeat with particulate material of increasing coarseness (preferably at 30% greater particle size steps) until the error of separation (Ep) increases significantly (see FIG. 8).
7. Determine optimum media coarseness from the graph drawn (i.e. the maximum particle size before the error of separation starts to increase significantly).

Referring now to FIG. 5, Table 1 shows typical particle sizes (coarseness) for the particulate material used to create a dense magnetic medium depending on the desired specific gravity of the dense magnetic medium, the size (internal diameter) of the cyclone vessel 12, the particulate material shape and type, the solids particle size and type, the feed pressure of the combined solids and suspension, and a desired specific gravity of said suspension, in the absence of a magnetic field. The values given in Table 1 relate to particle sizes that may be selected to provide optimum separation efficiency. The cyclone diameters given in Table 1 (and Table 2 shown in FIG. 6) relate to the widest internal diameter, e.g. the diameter of the cylindrical section 4 in FIG. 1, or at the top of the frustum section 5. Particle sizes are also given in industry standard notation, for example: X %−Y μm, meaning that for a quantity of the particulate material (typically a quantity of powder) approximately X % of the particles are small enough to pass through a sieve having apertures with a diameter or width of Y μm; or X %+Y μm, meaning that for a quantity of the particles (typically a quantity of powder) approximately X % of the particles are too large to pass through a sieve having apertures with a diameter or width of Y μm. It will be understood that the apertures need not be circular but it is assumed that the aperture shape is regular such that there is no substantial variation in width along different axes. For example, from Table 1 the grade of a quantity of magnetite used in a cyclone with diameter of 100 mm for a density cut point specific gravity of 2.22 is such that approximately 92% of the particles are small enough to pass through a 45 μm sieve. It will be understood that in each case the sieve may be a notional sieve. Accordingly the sieve width figure represents a measure of the particle size, e.g. width. In some cases (e.g. for atomised particles), the shape of the particles may be such that there is no substantial variation in width along different particle axes. In other cases (e.g. for milled particles) the shape of the particles may be less regular in which case the particle width may not be identical along different particle axes.

DMS plants using corrosive water, such as sea water, may use coarser media than plants using non-corrosive water because the media experiences a size reduction during operation due to corrosion by the corrosive water. The size fraction of the operating media is therefore usually finer in plants with corrosive process water than the grade of media added.

Referring now to FIG. 6, Table 2 shows preferred particle sizes (coarseness) for the particulate material used to create a dense magnetic medium depending on the desired specific gravity of the dense magnetic medium and on the size (internal diameter) of the cyclone vessel 12 when a substantially vertical, inwardly and upwardly directed magnetic field is applied, in use, to the dense magnetic medium in the cyclone. The values given in Table 2 relate to particle sizes that may be selected to provide optimum separation efficiency. Table 2 uses the same notation as Table 1.

A comparison between Table 1 (Non-magnetic DMS Cyclone) and Table 2 (Magnetic DMS cyclone) demonstrates that significantly increased media particle sizes can be used—while improving or at least maintaining the optimal separation efficiency by applying a magnetic field through the DMS cyclone 12.

Ferrosilicon and magnetite are ferromagnetic materials and have magnetic susceptibilities far in excess of any material normally being treated by DMS such as hematite (paramagnetic). The magnetic polarisation of hematite is about 0.5% that of magnetite. Therefore the use of a magnetic field in a DMS cyclone is suitable for all materials except ferromagnetic materials. This is not a practical limitation as low intensity magnetic separation is the preferred method of separation for ferromagnetic materials.

The benefits of the ability to use a suspension media (particulate material) having a larger mean particle size through the use of the method of the present invention include:—

1. Reduced media consumption;
2. Increased product throughput;
3. Method can be easily retrofitted to existing plant at low cost;
4. Increased cut point and improved process control;
5. Lower density and lower cost suspension media, such as magnetite, can be used in place of more expensive higher density media, such as ferrosilicon.

The invention is not limited to the embodiments described herein and may be modified or varied without departing from the scope of the invention.

The invention claimed is:

1. A method of separating solids, the method comprising:

adding said solids to a suspension of particulate material comprising magnetic, or magnetized, particles in a liquid;

passing said suspension into a separation vessel having an inlet, an underflow and an overflow, the particles of said particulate material having a nominal coarseness determined as a function of at least one of a side of the separation vessel, a particulate material shape and type, a solid particle size and type, a feed pressure of the combined solids and suspension, and a desired specific gravity of said suspension in an absence of a magnetic field;

locating the combined solids and suspension in the separation vessel such that rotation is imparted to the combined solids and suspension around a space bounded by an outer wall of the separation vessel to impart a centrifugal force on the solids; and applying, during operation of said separation vessel, the magnetic field to said combined solids and suspension in said separation vessel, wherein said method further comprises:

(a) increasing a coarseness of the particles of said particulate material from a nominal particle size by a predetermined amount;

(b) determining a density differential as a function of the magnetic field and identifying a magnetic flux density required to reduce the density differential to a predetermined optimum value;

(c) determining a density cut point and error of separation at said magnetic flux density;

(d) further increasing the coarseness of the particles in predetermined steps and repeating steps (b) and (c) until the error of separation increases; and (e) determining a maximum particle coarseness used before the error of separation increased and using said maximum particle coarseness for subsequently separating the solids while applying the magnetic field to the combined solids and suspension in the separation vessel.

2. A method as claimed in claim 1, wherein said separation method comprises a Dense Media Separation method.

3. A method as claimed in claim 1, wherein said suspension of particulate material preferably comprises a magnetic dense medium.

4. A method as claimed in claim 1, wherein said separation vessel comprises a cyclone vessel.

5. A method as claimed in claim 4, wherein said separation vessel comprises a dense medium cyclone.

6. A method as claimed in claim 1, wherein said particulate material comprises magnetite, ferrosilicon or a mixture of magnetite and ferrosilicon.

7. A method as claimed in claim 1, wherein the coarseness of the particles of said particulate material is increased by 30% between said predetermined steps.

8. A method as claimed in claim 1, further comprising the initial step of determining the density cut point and error of separation of the separation method when using particulate material having said nominal coarseness.

9. A method as claimed in claim 1, wherein the density cut point and error of separation are determined using tracer tests or densiometric analysis.

10. A method as claimed in claim 1, wherein said predetermined optimum value of the density differential is 0.4 $g/cm^3$.

11. A method as claimed in claim 1, wherein said magnetic flux density applied to the combined solids and suspension is between 1 and 300 gauss (between 0.1 and 30 mT).

* * * * *